US010199731B2

(12) United States Patent
Chiu et al.

(10) Patent No.: US 10,199,731 B2
(45) Date of Patent: Feb. 5, 2019

(54) ELECTRONIC COMPONENT

(71) Applicant: Siliconware Precision Industries Co., Ltd., Taichung (TW)

(72) Inventors: Chih-Hsien Chiu, Taichung (TW); Heng-Cheng Chu, Taichung (TW); Cheng-Yu Chiang, Tauchung (TW)

(73) Assignee: Siliconware Precision Industries Co., Ltd., Taichung (TW)

( * ) Notice: Subject to any disclaimer, the term of this patent is extended or adjusted under 35 U.S.C. 154(b) by 7 days.

(21) Appl. No.: 15/455,664

(22) Filed: Mar. 10, 2017

(65) Prior Publication Data

US 2017/0187117 A1 Jun. 29, 2017

Related U.S. Application Data

(62) Division of application No. 14/151,184, filed on Jan. 9, 2014, now Pat. No. 9,627,748.

(30) Foreign Application Priority Data

Dec. 9, 2013 (TW) ..... 102145090 A

(51) Int. Cl.
*H01Q 1/38* (2006.01)
*H01Q 9/04* (2006.01)
*H01Q 1/40* (2006.01)

(52) U.S. Cl.
CPC ..... *H01Q 9/0421* (2013.01); *H01Q 1/38* (2013.01); *H01Q 1/40* (2013.01)

(58) Field of Classification Search
CPC .. H01Q 1/38; H01Q 1/40; H01Q 1/24; H01Q 9/0421; H01Q 9/0407; H01Q 9/045
See application file for complete search history.

(56) References Cited

U.S. PATENT DOCUMENTS

| | | | | |
|---|---|---|---|---|
| 6,188,364 | B1 * | 2/2001 | Scordilis ..... | H01Q 1/244 343/702 |
| 6,781,546 | B2 | 8/2004 | Wang et al. | |
| 6,917,346 | B2 * | 7/2005 | Izzat ..... | H01Q 1/246 343/700 MS |
| 7,057,565 | B1 * | 6/2006 | Liu ..... | H01Q 1/242 343/700 MS |

(Continued)

*Primary Examiner* — Tho G Phan

(74) *Attorney, Agent, or Firm* — Mintz Levin Cohn Ferris Glovsky and Popeo, P.C.; Peter F. Corless; Steven M. Jensen

(57) ABSTRACT

An electronic component is provided, which includes a substrate having opposite first and second surfaces and an antenna structure combined with the substrate. The antenna structure has at least a first extending portion disposed on the first surface of the substrate, at least a second extending portion disposed on the second surface of the substrate, and a plurality of connecting portions disposed in the substrate for electrically connecting the first extending portion and the second extending portion. Any adjacent ones of the connecting portions are connected through one of the first extending portion and the second extending portion. As such, the antenna structure becomes three-dimensional. The present invention does not need to provide an additional region on the substrate for disposing the antenna structure, thereby reducing the width of the substrate so as to meet the miniaturization requirement of the electronic component.

7 Claims, 5 Drawing Sheets

(56) References Cited

U.S. PATENT DOCUMENTS

| | | | | |
|---|---|---|---|---|
| 7,274,334 | B2 * | 9/2007 | O'Riordan | H01Q 1/243 343/700 MS |
| 7,407,112 | B2 | 8/2008 | Kanagawa et al. | |
| 8,456,369 | B2 | 6/2013 | Chen et al. | |
| 9,894,758 | B2 * | 2/2018 | Kimura | H05K 1/0284 |
| 2005/0168397 | A1 | 8/2005 | Kaluzni et al. | |
| 2010/0231460 | A1 | 9/2010 | Chiang et al. | |
| 2014/0320376 | A1 | 10/2014 | Ozdemir | |

* cited by examiner

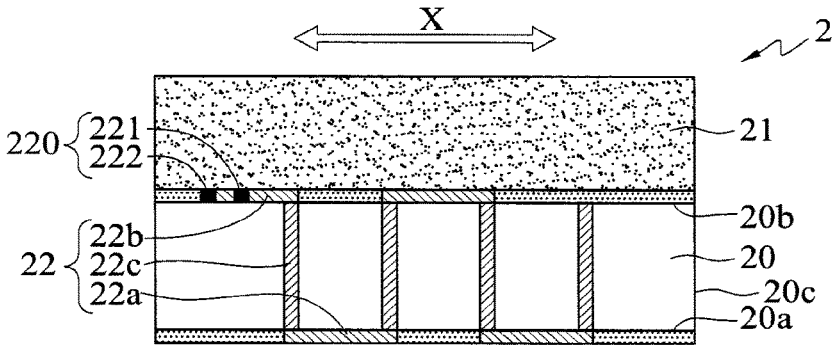
FIG. 2A
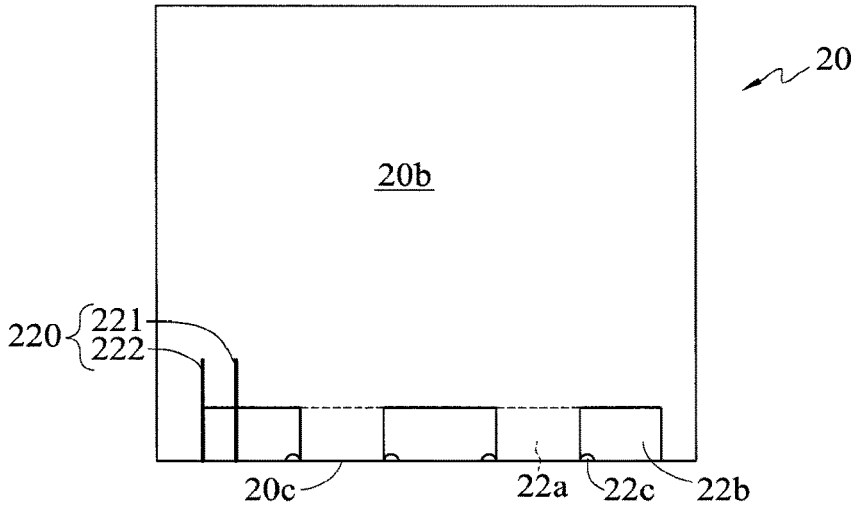
FIG. 2A'
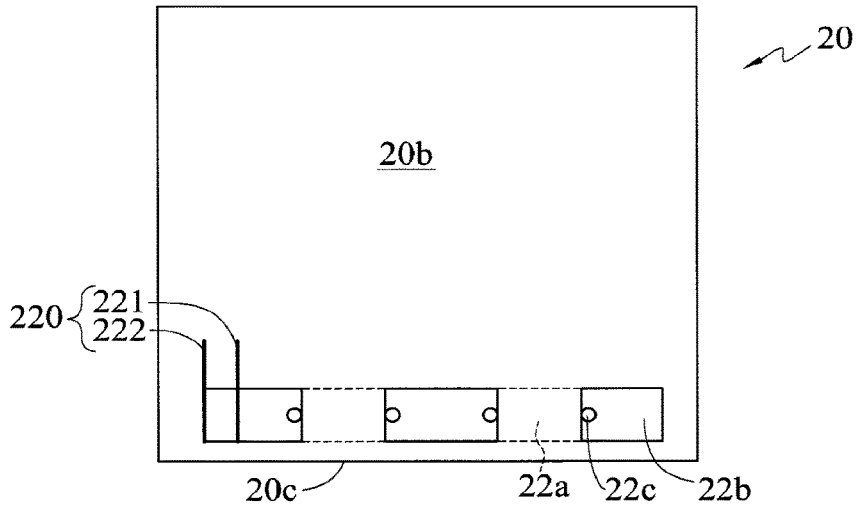
FIG. 2A"

ELECTRONIC COMPONENT

CROSS-REFERENCE TO RELATED APPLICATIONS

This application is a divisional of copending application U.S. Ser. No. 14/151,184, filed on Jan. 9, 2014, which claims under 35 U.S.C. § 119(a) the benefit of Taiwanese Application No. 102145090, filed Dec. 9, 2013, the entire contents of which are incorporated herein by reference.

BACKGROUND OF THE INVENTION

1. Field of the Invention

The present invention relates to electronic components, and more particularly, to an electronic component having an antenna structure.

2. Description of Related Art

Along with the rapid development of electronic industries, electronic products are developed toward the trend of multi-function and high performance. Wireless communication technologies have been widely applied in various kinds of consumer electronic products for receiving or transmitting various wireless signals. To meet the miniaturization requirement of consumer electronic products, wireless communication modules are becoming lighter, thinner, shorter and smaller. For example, patch antennas have been widely applied in wireless communication modules of electronic products such as cell phones and personal digital assistants (PDAs) due to their advantages of small size, light weight and easy fabrication.

FIG. 1 is a schematic perspective view of a conventional wireless communication module. Referring to FIG. 1, the wireless communication module 1 has: a substrate 10, a plurality of electronic elements 11 disposed on and electrically connected to the substrate 10, an antenna structure 12 disposed on the substrate 10, and an encapsulant 13. The substrate 10 is a circuit board and has a rectangular shape. The antenna structure 12 is of a planar type. The antenna structure 12 has an antenna body 120 and a conductive wire 121 electrically connecting the antenna body 120 to the electronic elements 11. The encapsulant 13 encapsulates the electronic elements 11 and a portion of the conductive wire 121.

However, during the fabrication process of the wireless communication module 1, based on the characteristic of electromagnetic radiation between the planar-type antenna structure 12 and the electronic elements 11 and limitation of the size of the planar-type antenna structure 12, the antenna body 120 of the antenna structure 12 cannot be integrally fabricated with the electronic elements 11. That is, only the electronic elements 11 are covered by the encapsulant 13 while the antenna body 120 of the antenna structure 12 is exposed from the encapsulant 13. Therefore, the molding process for forming the encapsulant 13 needs to use a mold having a size corresponding to the electronic element-mounting region instead of the overall substrate 10, thus complicating the molding process.

Further, the planar-type antenna structure 12 requires an additional region on the substrate 10 (i.e., a region where the encapsulant 13 is not formed) for disposing the antenna body 120. As such, the width of the substrate 10 is increased, thus increasing the width of the wireless communication module 1 and hindering miniaturization of the wireless communication module 1.

Therefore, how to overcome the above-described drawbacks has become urgent.

SUMMARY OF THE INVENTION

In view of the above-described drawbacks, the present invention provides an electronic component, which comprises: a substrate having opposite first and second surfaces; and an antenna structure combined with the substrate, wherein the antenna structure has at least a first extending portion disposed on the first surface of the substrate, at least a second extending portion disposed on the second surface of the substrate, and a plurality of connecting portions disposed in the substrate for electrically connecting the first extending portion and the second extending portion, any adjacent ones of the connecting portions being connected through one of the first extending portion and the second extending portion.

The present invention provides another electronic component, which comprises: a substrate having opposite first and second surfaces; and an antenna structure combined with the substrate, wherein the antenna structure has a first extending portion disposed on the first surface of the substrate and at least a connecting portion disposed in the substrate and electrically connected to the first extending portion.

In the above-described electronic component, the antenna structure can further have a second extending portion disposed on the second surface of the substrate and electrically connected to the connecting portion.

The present invention provides a further electronic component, which comprises: a substrate having opposite first and second surfaces; and an antenna structure combined with the substrate, wherein the antenna structure has a plurality of extending portions separately arranged in a direction from the first surface of the substrate toward the second surface of the substrate and a plurality of connecting portions disposed in the substrate for electrically connecting the extending portions, and the positions of the connecting portions are arranged in an alternate staggered pattern in the direction from the first surface of the substrate toward the second surface of the substrate.

In the above-described electronic components, the substrate can further have a side surface adjacent to the first surface and the second surface, and the connecting portion (s) are arranged to be exposed from the side surface of the substrate.

In the above-described electronic components, the antenna structure can further have an action portion disposed on the second surface of the substrate. The action portion can have a ground portion and a feeding portion.

The above-described electronic components can further comprise an antenna body disposed on the second surface of the substrate, wherein the antenna body has at least a support portion disposed on the second surface of the substrate and an external connecting portion connected to the support portion so as to be supported by the support portion over the second surface of the substrate, the external connecting portion of the antenna body being electrically connected to the connecting portion(s) of the antenna structure. In an embodiment, the support portion is electrically connected to the connecting portion(s). In another embodiment, the support portion is electrically connected the second extending portion (or the extending portions).

The above-described electronic components can further comprise an encapsulant formed on the second surface of the substrate.

According to the present invention, the antenna structure is three-dimensional. For example, the extending portions are disposed on the surfaces of the substrate and the connecting portions are disposed in the substrate. As such, the antenna structure can be disposed in the region where the encapsulant is to be formed. Therefore, the present invention can use a mold having a size corresponding to the substrate so as to facilitate the molding process for forming the encapsulant. Also, the present invention eliminates the need to provide an additional region on the substrate for disposing the antenna structure as in the prior art, thus reducing the width of the substrate so as to effectively reduce the width of the electronic component and meet the miniaturization requirement of the electronic component.

Further, by supporting the external connecting portion of the antenna body over the substrate, the present invention can form the encapsulant to cover the extending portions of the antenna structure. Therefore, the mold can have a size corresponding to the substrate so as to facilitate the molding process. Moreover, the external connecting portion of the antenna body can be disposed in the region where the encapsulant is to be formed, thereby eliminating the need to provide an additional region on the substrate for disposing the external connecting portion. Therefore, the present invention reduces the width of the substrate so as to effectively reduce the width of the electronic component and meet the miniaturization requirement of the electronic component.

BRIEF DESCRIPTION OF DRAWINGS

FIG. 2A is a schematic cross-sectional view of an electronic component according to a first embodiment of the present invention;

FIGS. 2A' and 2A" are schematic upper views of FIG. 2A;

DETAILED DESCRIPTION OF PREFERRED EMBODIMENTS

Figure 1:
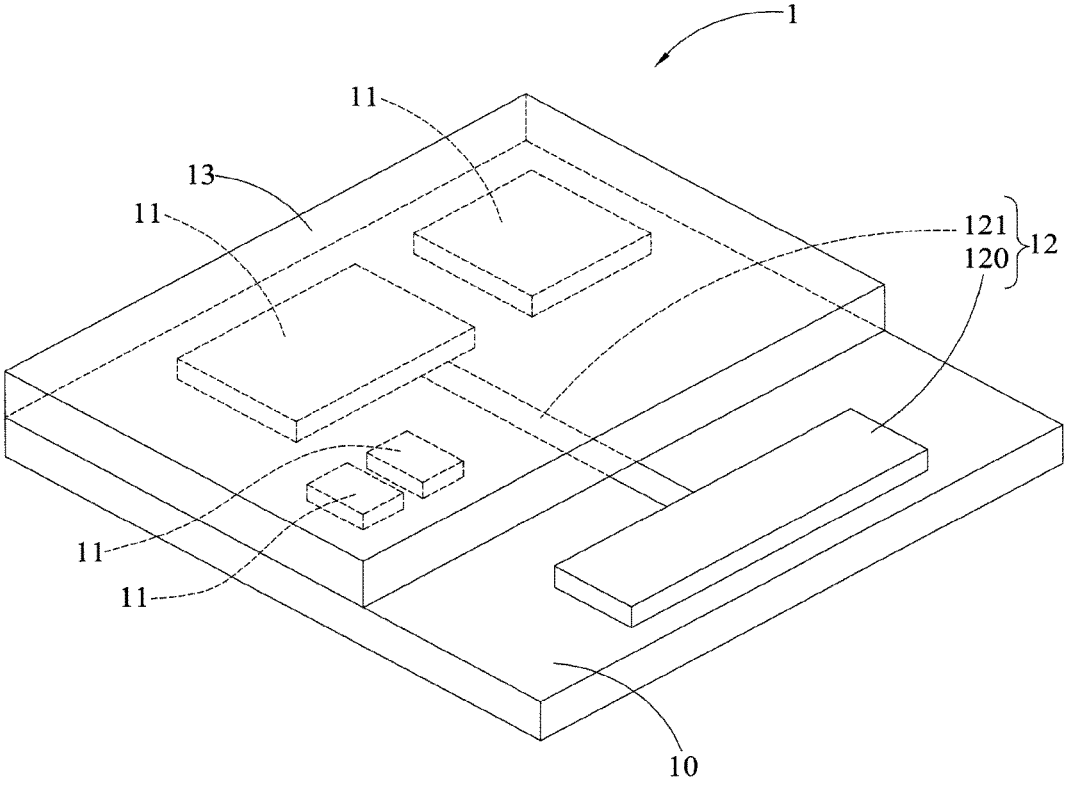
FIG. 1 (PRIOR ART)
FIG. 1 is a schematic perspective view of a conventional wireless communication module.

The following illustrative embodiments are provided to illustrate the disclosure of the present invention, these and other advantages and effects can be apparent to those in the art after reading this specification.

It should be noted that all the drawings are not intended to limit the present invention. Various modifications and variations can be made without departing from the spirit of the present invention. Further, terms such as "first", "second", "on", "a" etc. are merely for illustrative purposes and should not be construed to limit the scope of the present invention.

FIGS. 2A to 2A" are schematic cross-sectional and upper views showing an electronic component 2 according to a first embodiment of the present invention.

Referring to FIG. 2A, the electronic component 2 is a SiP (system in package) wireless communication module. The electronic component 2 has a substrate 20 having opposite first and second surfaces 20*a*, 20*b*, an encapsulant 21 formed on the second surface 20*b* of the substrate 20 and an antenna structure 22 combined with the substrate 20.

The substrate 20 can be, but not limited to, a circuit board or a ceramic board. The substrate 20 can have a plurality of circuits (not shown).

In the present embodiment, the substrate 20 further has a side surface 20*c* adjacent to the first surface 20*a* and the second surface 20*b*. A plurality of electronic elements (not shown), such as semiconductor elements, active elements or passive elements, are disposed on the substrate 20 and electrically connected to the circuits of the substrate 20.

The antenna structure 22 is made of metal. The antenna structure 22 has a plurality of first extending portions 22*a* disposed on the first surface 20*a* of the substrate 20, a plurality of second extending portions 22*b* disposed on the second surface 20*b* of the substrate 20, and a plurality of connecting portions 22*c* disposed in the substrate 20 for electrically connecting the first extending portions 22*a* and the second extending portions 22*b*. Further, adjacent connecting portions 22*c* are connected through one of the first extending portions 22*a* and the second extending portions 22*b*. As such, the positions of the first extending portions 22*a* are not aligned with the positions of the second extending portions 22*b*. For example, the positions of the first extending portions 22*a* and the second extending portions 22*b* are alternately arranged.

In the present embodiment, the first extending portions 22*a* and the second extending portions 22*b* are alternately arranged and extend zigzag along the width direction of the substrate 20 (i.e., in a direction X in FIG. 2A).

The connecting portions 22*c* are metal vias penetrating the substrate 20 and exposed from the side surface 20*c* of the substrate 20, as shown in FIG. 2A'. In another embodiment, the connecting portions 22*c* are not exposed from the side surface 20*c* of the substrate 20, as shown in FIG. 2A".

The antenna structure 22 further has an action portion 220 disposed on the second surface 20*b* of the substrate 20 and connected to the second extending portions 22*b*. The action portion 220 has a ground portion 221 and a feeding portion 222 in the ground portion 221.

The encapsulant 21 encapsulates the electronic elements, the action portion 220 and the second extending portions 22*b*.

Figure 2B:
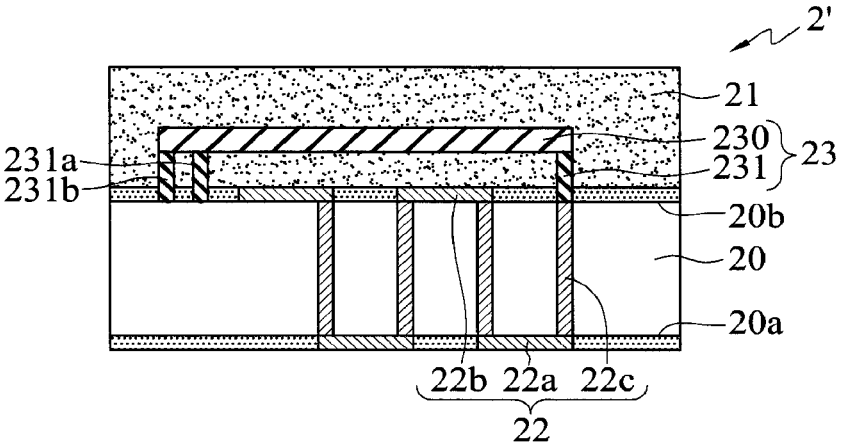
FIGS. 2B and 2B' are schematic cross-sectional views showing other embodiments of FIG. 2A.
Figure 2B:
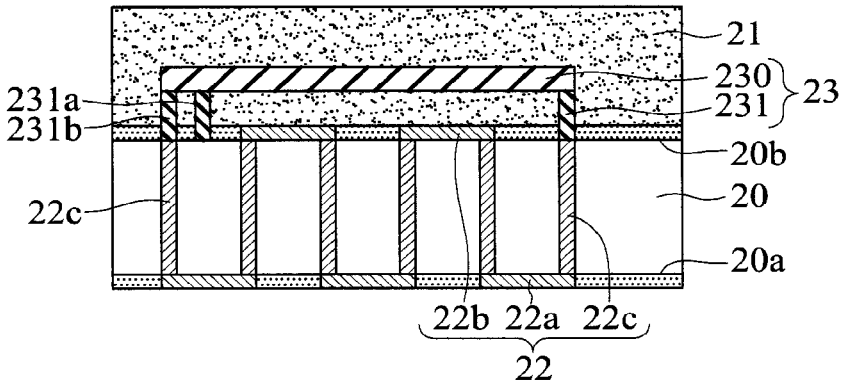

In other embodiments, referring to FIGS. 2B and 2B', the electronic component 2' further has an antenna body 23 disposed on the second surface 20*b* of the substrate 20. The antenna body 23 has a plurality of support portions 231 disposed on the second surface 20*b* of the substrate 20 and an external connecting portion 230 connected to the support portions 231 so as to be supported by the support portions 231 over the second surface 20*b* of the substrate 20. As such, the external connecting portion 230 is positioned to be higher than the electronic elements. Further, the external connecting portion 230 correspondingly extends along side edges of the substrate 20 to surround the electronic elements. In an embodiment, at least one support portion 231 is provided to serve as an input terminal electrically connected to the circuits or a ground terminal, and the external connecting portion 230 serves as an antenna body. The external connecting portion 230 can be a ring-shaped body having an opening, for example, a substantially C-shaped body or a substantially n-shaped body. In other embodiments, the external connecting portion 230 can be a bent-shaped body, such as an L-shaped body, or a ring-shaped body, such as a rectangular-shaped body.

The antenna body 23 is a metal frame, which comes into contact with the connecting portions 22*c* through the support portions 231 so as for the external connecting portion 230 to be electrically connected to the connecting portions 22*c*. Alternatively, the antenna body 23 can come into contact with the second extending portions 22*b* through the support portions 231 so as for the external connecting portion 230 to be electrically connected to the connecting portions 22*c*. Alternatively, the external connecting portion 230 and the connecting portions 22*c* (or the second extending portions 22*b*) can be electrically connected through wire bonding. Therefore, the support portions 231 not only can provide a support function but also can provide an electrical function.

Further referring to FIG. 2B, the support portion 231 on one end of the external connecting portion 230 is in contact with the connecting portion 22*c* (or the second extending portion 22*b*) and the support portions 231*a*, 231*b* on the other end of the external connecting portion 230 are grounded (or in contact with the circuits of the substrate 20).

Further referring to FIG. 2B', the support portion 231 on one end of the external connecting portion 230 is in contact with the connecting portion 22*c* (or the second extending portions 22*b*). On the other end of the external connecting portion 230, the support portion 231*a* is grounded (or in contact with the circuits of the substrate 20) and the support portion 231*b* is in contact with the connecting portion 22*c*.

In addition, the encapsulant 21 encapsulates the electronic elements, the external connecting portion 230, the support portions 231 and the second extending portions 22*b*.

In the electronic component 2, 2' of the present invention, the antenna structure 22 is three-dimensional. The first and second extending portions 22*a*, 22*b* are disposed on the first and second surfaces 20*a*, 20*b* of the substrate 20, respectively, and the connecting portions 22*c* are disposed in the substrate 20. As such, the antenna structure 22 is disposed in a region where the encapsulant 21 is to be formed. Therefore, the present invention can use a mold having a size corresponding to the substrate 20 so as to facilitate the molding process for forming the encapsulant 21. Also, the present invention eliminates the need to provide an additional region on the substrate 20 for disposing the antenna structure 22 as in the prior art. Therefore, the present invention reduces the width of the substrate 20 so as to reduce the width of the electronic component 2, 2' and meet the miniaturization requirement of the electronic component 2, 2'.

On the other hand, by forming the 3D antenna body 23 from a metal sheet and supporting the external connecting portion 230 over the second surface 20*b* of the substrate 20 to surround the electronic elements, the present invention allows the external connecting portion 230 and the electronic elements to be integrally fabricated. That is, both the external connecting portion 230 and the electronic elements can be encapsulated by the encapsulant 21. Therefore, the mold can have a size corresponding to the substrate 20 so as to facilitate the molding process.

Further, the encapsulant 21 facilitates to securely fix the antenna body 23 and positioning the external connecting portion 230 to a certain height. Furthermore, the dielectric constant of the encapsulant 21 can reduce the required electrical length of the antenna.

Moreover, by disposing the antenna body 23 in the same region as the electronic elements (i.e., the region for forming the encapsulant 21), the present invention eliminates the need to provide an additional region on the second surface 20*b* of the substrate 20 for disposing the antenna body 23. Therefore, the present invention can reduce the width of the substrate 20 so as to reduce the width of the electronic component 2, 2' and meet the miniaturization requirement of the electronic component 2, 2'.

Also, by disposing the external connecting portion 230 over the second surface 20*b* of the substrate 20, a receiving space can be formed between the external connecting portion 230 and the substrate 20 for receiving other electrical structures.

Figure 3A:
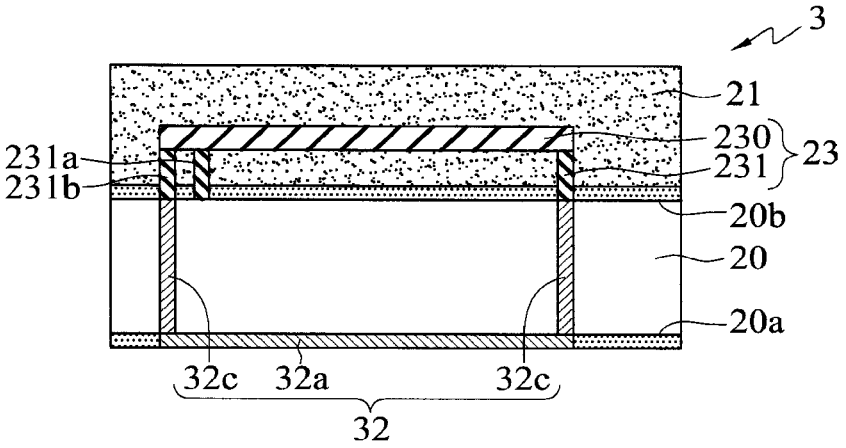
FIG. 3A is a schematic cross-sectional view of an electronic component according to a second embodiment of the present invention.
Figure 3B:
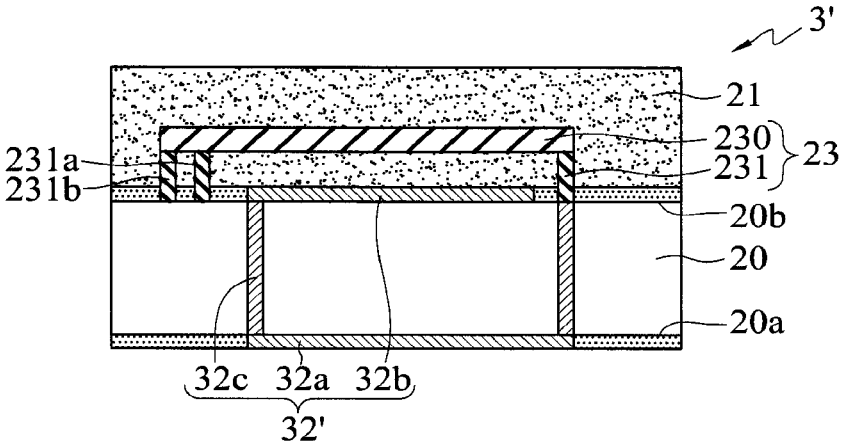
FIGS. 3B and 3B' are schematic cross-sectional views showing other embodiments of FIG. 3A.
Figure 3B:
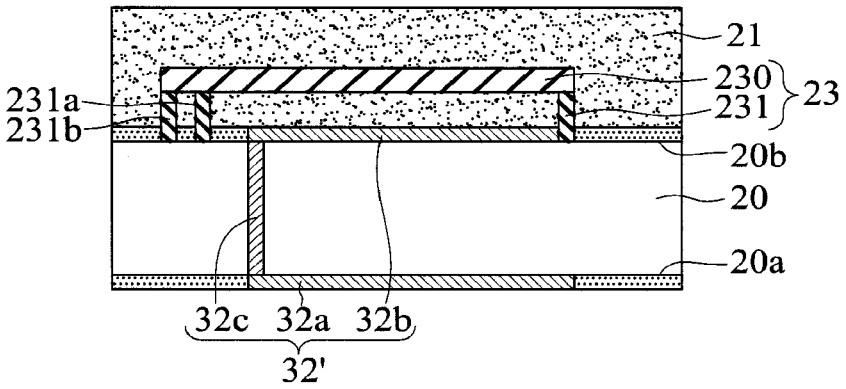

FIG. 3A to 3B' are schematic cross-sectional views showing an electronic component 3, 3' according to a second embodiment of the present invention.

Referring to FIG. 3A, the antenna structure 32 has a first extending portion 32*a* disposed on the first surface 20*a* of the substrate 20 and a plurality of connecting portions 32*c* disposed in the substrate 20 and electrically connected to the first extending portion 32*a*. The connecting portions 32*c* are respectively connected to two opposite ends of the first extending portion 32*a*, and no second extending portion is formed on the second surface 20*b* of the substrate 20.

Further, the support portion 231 on one end of the external connecting portion 230 is in contact with the connecting portion 32*c*. On the other end of the external connecting portion 230, the support portion 231*a* is grounded (or in contact with the circuits of the substrate 20) and the support portion 231*b* is in contact with the connecting portion 32*c*.

In another embodiment, referring to FIG. 3B, the antenna structure 32' further has a second extending portion 32*b* disposed on the second surface 20*b* of the substrate 20 and electrically connected to the connecting portions 32*c*. The first extending portion 32*a* and the second extending portion 32*b* correspond in position to one another, but they are not completely aligned with one another. For example, the area of the second extending portion 32*b* is less than the area of the first extending portion 32*a*. Therefore, the connecting portion 32*c* on one end of the first extending portion 32*a* is connected to the second extending portion 32*b*, and the connecting portion 32*c* on the other end of the first extending portion 32*a* is connected to the antenna body 23.As such, the support portion 231 on one end of the external connecting portion 230 is in contact with the connecting portion 32*c* and the support portions 231*a*, 231*b* on the other end of the external connecting portion 230 are grounded or in contact with the circuits of the substrate 20.

In another embodiment, referring to FIG. 3B', the first extending portion 32*a* and the second extending portion 32*b* correspond in position to one another and are aligned with one another. Therefore, only one connecting portion 32*c* can be provided to connect the first extending portion 32*a* and the second extending portion 32*b*. Therefore, the support portion 231 on one end of the external connecting portion 230 is in contact with the second extending portion 32*b* so as to electrically connect the external connecting portion 230 to the connecting portion 32*c*, and the support portions 231*a*, 231*b* on the other end of the external connecting portion 230 are grounded (or in contact with the circuits of the substrate 20).

In the electronic component 3, 3', the antenna structure 32, 32' is three-dimensional. The first and second extending portions 32*a*, 32*b* are disposed on the first and second surfaces 20*a*, 20*b* of the substrate 20, respectively, and the connecting portions 32*c* are disposed in the substrate 20. As such, the antenna structure 32, 32' can be disposed in the region where the encapsulant 21 is to be formed. Therefore, the mold can have a size corresponding to the size of the substrate 20 so as to facilitate the molding process. Also, the present invention does not need to provide an additional region on the substrate 20 for disposing the antenna structure 32, 32', thus reducing the width of the substrate 20 so as to reduce the width of the electronic component 3, 3' and meet the miniaturization requirement of the electronic component 3, 3'.

Figure 4A:
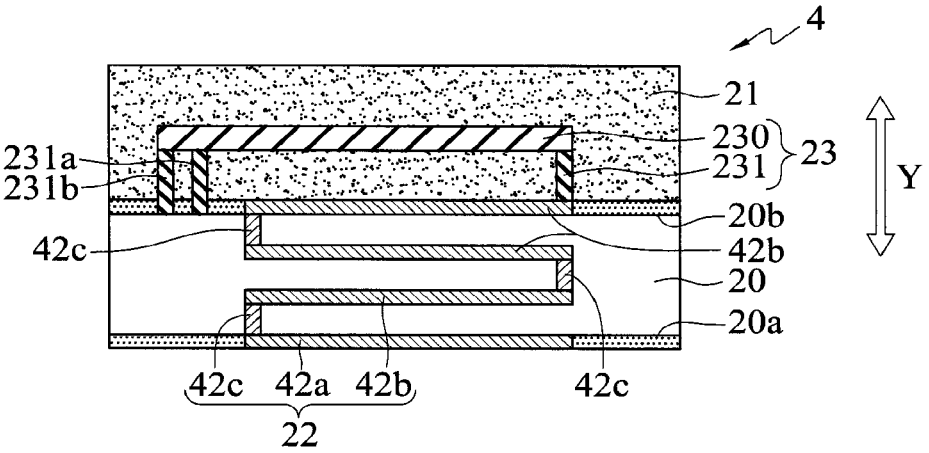
FIG. 4A is a schematic cross-sectional view of an electronic component according to a third embodiment of the present invention.

FIG. 4A is a schematic cross-sectional view of an electronic component 4 according to a third embodiment of the present invention.

Referring to FIG. 4A, the antenna structure 42 has a plurality of extending portions 42*a*, 42*b* and a plurality of connecting portions 42*c* disposed in the substrate 20. The extending portions 42*a*, 42*b* are separately arranged in a direction Y from the first surface 20*a* toward the second surface 20*b* of the substrate and connected through the connecting portions 42*c*. The connecting portions 42*c* are arranged in an alternate staggered pattern in the direction Y from the first surface 20*a* toward the second surface 20*b* of the substrate 20 such that the antenna structure 42 is extended zigzag in the direction Y, i.e., along the height direction of the substrate 20.

Further, the support portion 231 on one end of the external connecting portion 230 is in contact with the extending portion 42*b* on the second surface 20*b* (or the connecting portion 42*c*), and the support portions 231 on the other end of the external connecting portion 230 are grounded (or in contact with the circuits of the substrate 20).

Figure 4B:
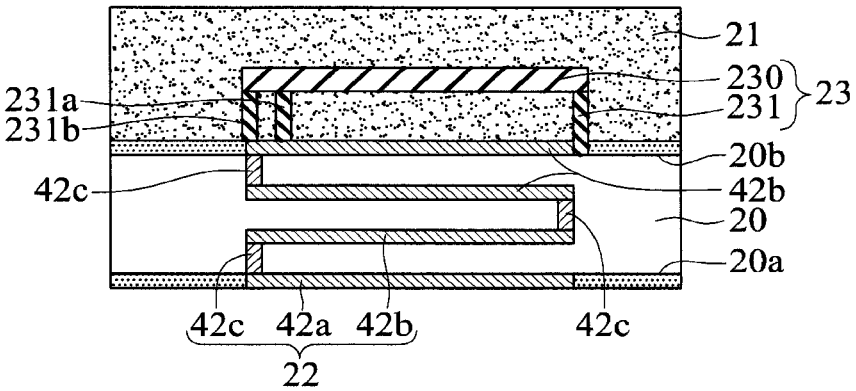
FIG. 4B is a schematic cross-sectional view showing another embodiment of FIG. 4A.

In another embodiment, referring to FIG. 4B, the support portion 231 on one end of the external connecting portion 230 is in contact with the extending portion 42*b* on the second surface 20*b* (or the connecting portions 42*c*), and the support portions 231 on the other end of the external connecting portion 230 are in contact with the connecting portion 42*c* (or the extending portion 42*b* on the second surface 20*b*).

In the electronic component 4, the antenna structure 42 is three-dimensional. The extending portions 42*a*, 42*b* are separately arranged in a direction from the first surface 20*a* toward the second surfaces 20*b* of the substrate 20, and the connecting portions 42*c* are disposed in the substrate 20. As such, the antenna structure 42 can be disposed in the region where the encapsulant 21 is to be formed. Therefore, the mold can have a size corresponding to the size of the substrate 20 so as to facilitate the molding process. Also, the present invention does not need to provide an additional region on the substrate 20 for disposing the antenna structure 42, thus reducing the width of the substrate 20 so as to reduce the width of the electronic component 4 and meet the miniaturization requirement of the electronic component 4.

Therefore, the present invention provides a three-dimensional antenna structure to replace the conventional planar type antenna structure. Since the three-dimensional antenna structure can be disposed in a region where the encapsulant is to be formed, the present invention can reduce the width of the electronic component to meet the miniaturization requirement.

Further, by supporting the three-dimensional antenna body over the electronic element-mounting region, the present invention facilitates the molding process and reduces the width of the electronic component to meet the miniaturization requirement.

The above-described descriptions of the detailed embodiments are only to illustrate the preferred implementation according to the present invention, and it is not to limit the scope of the present invention. Accordingly, all modifications and variations completed by those with ordinary skill in the art should fall within the scope of present invention defined by the appended claims.

What is claimed is:

1. An electronic component, comprising:

a substrate having opposite first and second surfaces;

an antenna structure combined with the substrate, wherein the antenna structure has a plurality of extending portions separately arranged in a direction from the first surface of the substrate toward the second surface of the substrate and a plurality of connecting portions disposed in the substrate for electrically connecting the extending portions, the connecting portions being arranged in an alternate staggered pattern in the direction from the first surface of the substrate toward the second surface of the substrate; and an antenna body disposed on the second surface of the substrate, wherein the antenna body has at least a support portion disposed on the second surface of the substrate and an external connecting portion connected to the support portion so as to be supported by the support portion over the second surface of the substrate, the external connecting portion of the antenna body being electrically connected to the connecting portions of the antenna structure.

2. The component of claim 1, wherein the substrate further has a side surface adjacent to the first surface and the second surface, and the connecting portions are exposed from the side surface of the substrate.

3. The component of claim 1, wherein the antenna structure further has an action portion disposed on the second surface of the substrate.

4. The component of claim 3, wherein the action portion has a ground portion and a feeding portion.

5. The component of claim 1, wherein the support portion is electrically connected to the connecting portions.

6. The component of claim 1, wherein the support portion is electrically connected to the extending portions.

7. The component of claim 1, further comprising an encapsulant formed on the second surface of the substrate.

* * * * *